United States Patent [19]

Wu

[11] Patent Number: 4,986,294

[45] Date of Patent: Jan. 22, 1991

[54] AUTOMATIC UMBRELLA HAVING SMOOTHLY-OPERATING SPRINGS

[76] Inventor: Tsun-Zong Wu, No. 16, Chen Tai Road, Sec. 3, Wu-Ku Itsiang, Taipei Hsien, Taiwan, 24801

[21] Appl. No.: 539,430

[22] Filed: Jun. 18, 1990

Related U.S. Application Data

[63] Continuation-in-part of Ser. No. 425,463, Oct. 23, 1989, Pat. No. 4,941,494.

[51] Int. Cl.[5] ..... A45B 25/14

[52] U.S. Cl. ..... 135/22; 135/24; 135/31; 135/29

[58] Field of Search ..... 135/20 M, 22, 24, 23, 135/28, 29, 20 R, 31, 25 R

[56] References Cited

U.S. PATENT DOCUMENTS

| | | | |
|---|---|---|---|
| 1,104,598 | 7/1914 | Wyskosky | 135/23 |
| 1,469,495 | 10/1923 | Bunker | 135/31 X |
| 1,567,861 | 12/1925 | Rothschild | 135/29 |
| 2,721,569 | 10/1955 | Militano | 135/20 M |
| 2,906,277 | 9/1959 | Militano | 135/22 |
| 3,658,077 | 4/1972 | Sato . | |
| 3,756,258 | 8/1973 | Yoshihara . | |
| 3,818,919 | 6/1974 | Schultes et al. | 135/25 R X |
| 4,548,222 | 10/1985 | Day | 135/20 R X |

FOREIGN PATENT DOCUMENTS

| | | | |
|---|---|---|---|
| 1188774 | 3/1965 | Fed. Rep. of Germany | 135/24 |
| 14560 | 10/1893 | United Kingdom | 135/31 |
| 943886 | 12/1963 | United Kingdom | 135/29 |

*Primary Examiner*—Henry E. Raduazo
*Assistant Examiner*—Lan Mai

[57] ABSTRACT

An automatic umbrella includes a retraction restoring spring having an outer spring end contracted to form a narrow spring portion to be embedded in a concavely depressed stretcher rib and having an inner spring end secured to a top rib of a rib assembly for holding an umbrella cloth for smoothly developing the restoring spring force, and an extending spring formed in the central tubular shaft having an upper spring portion having larger spring diameter to be telescopically held in an upper shaft having larger diameter and a lower spring portion having smaller spring diameter than the upper spring portion to be telecopically held in a lower shaft, thereby causing a smooth tensioning or compression of the extending spring in the upper shaft and the lower shaft when extending or retracting the central tubular shaft.

5 Claims, 2 Drawing Sheets

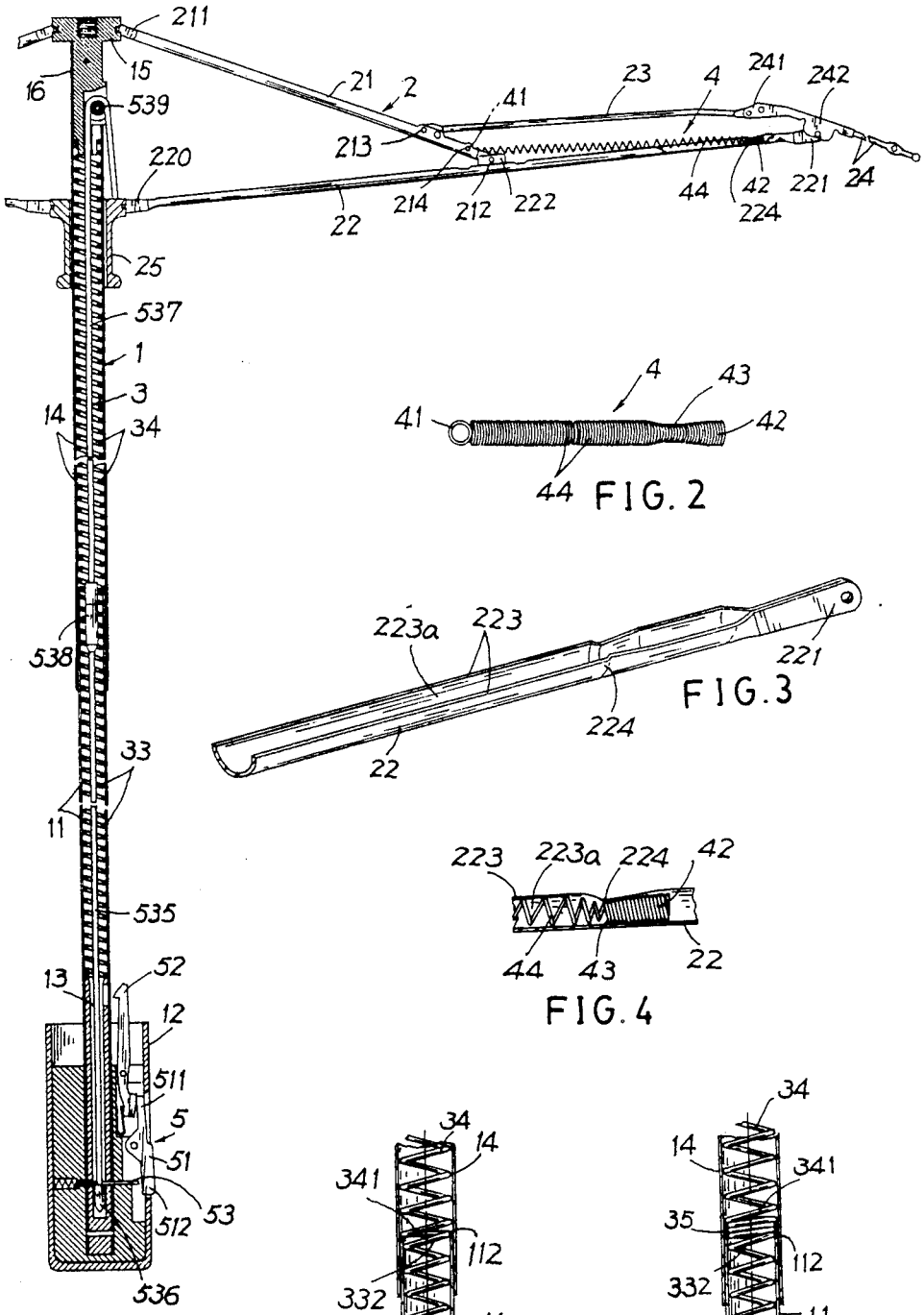
FIG. 1
FIG. 2
FIG. 3
FIG. 4
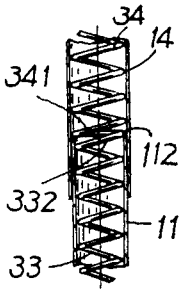
FIG. 5
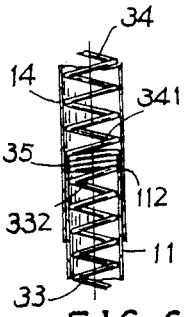
FIG. 6

AUTOMATIC UMBRELLA HAVING SMOOTHLY-OPERATING SPRINGS

This application is a continuation-in-part of U.S. Patent Application, Ser. No. 425,463 filed on Oct. 23, 1989, (hereinafter designated as "original application") by the same invention of this application, now U.S. Pat. No. 4,941,494, issued Jul. 17, 1990.

BACKGROUND OF THE INVENTION

Original application discloses an integral extending spring 3 for resiliently opening the umbrella, which integral coil spring 3 passes through an upper tubular shaft 14 and a lower tubular shaft 11 having smaller diameter than that of the upper shaft 14. Since the integral spring 3 should pass the lower shaft 11 with smaller inside diameter and the upper shaft 14 with larger inside diameter, there will exist an aperture between the spring coil rings of the upper spring section of the spring 3 disposed inside the upper shaft 14 and an inside tubular wall of the upper shaft 14, possible causing a twisting or tangling of the spring 3 for influencing the sliding movement of the coupling 538 and the flexible rope 537, and also possibly causing noise pollution by a fictional sliding contact of the twisting spring 3 with the inside wall of the shaft 14.

Meanwhile, the restoring coil spring of the retraction restoring means 4 of the original application as shown in originally filed drawings FIG. 2, having an inner spring end 41 secured to the first top rib 21 and having an outer spring end 42 secured to an outer end of the stretcher rib 22 at a joint connected with the third top rib 24, is still obvious to the prior arts such as Yoshihara's U.S. Pat. No. 3,756,258 (the spring 8 secured between a pivotal point b and the hub member 4) and Sato's U.S. Pat. No. 3,658,077 (the compressible coil spring 7 secured to the fitting 15 and ring 6*a*). The restoring spring either taught by Yoshihara or Sato or even the original application filed by the present inventor is longitudinally secured between two points distantly separated, which will easily be sagged, twisted, or tangled when compressed ready for restoring operation.

The present inventor has found the drawbacks of conventional automatic umbrellas and invented the present automatic umbrella having smoothly operating springs.

SUMMARY OF THE INVENTION

One object of the present invention is to provide an extending spring having a lower spring portion having a small diameter of each spring ring suitably held inside the lower shaft of small inside diameter and an upper spring portion having larger diameter of spring ring suitably held inside the upper shaft of larger inside diameter for a smooth tension and compression of the restoring spring inside the upper and lower tubular shafts.

Another object of the present invention is to provide an automatic umbrella provided with a retraction restoring spring having a contraction spring portion retained in a concavely depressed portion formed on an outer portion of the stretcher rib of U-shaped cross section so that during the compression or tensioning of the restoring spring, its partial spring portion will be slidably held in the U-shaped stretcher rib for tangentially developing the spring force of the restoring spring for smoothly actuating the restoring spring and for smoothly closing or opening the umbrella.

BRIEF DESCRIPTION OF THE DRAWINGS

FIG. 1 is an illustration showing an opening umbrella of the present invention, FIG. 2 shows a retraction restoring spring of the present invention.

FIG. 3 shows a stretcher rib of the present invention.

FIG. 4 shows an engagement of the restoring spring with the stretcher rib of the present invention.

FIG. 5 shows a preferred embodiment of the extending spring in the central shaft of the present invention.

FIG. 6 shows another preferred embodiment of the extending spring of the present invention.

DETAILED DESCRIPTION

Figure 9:
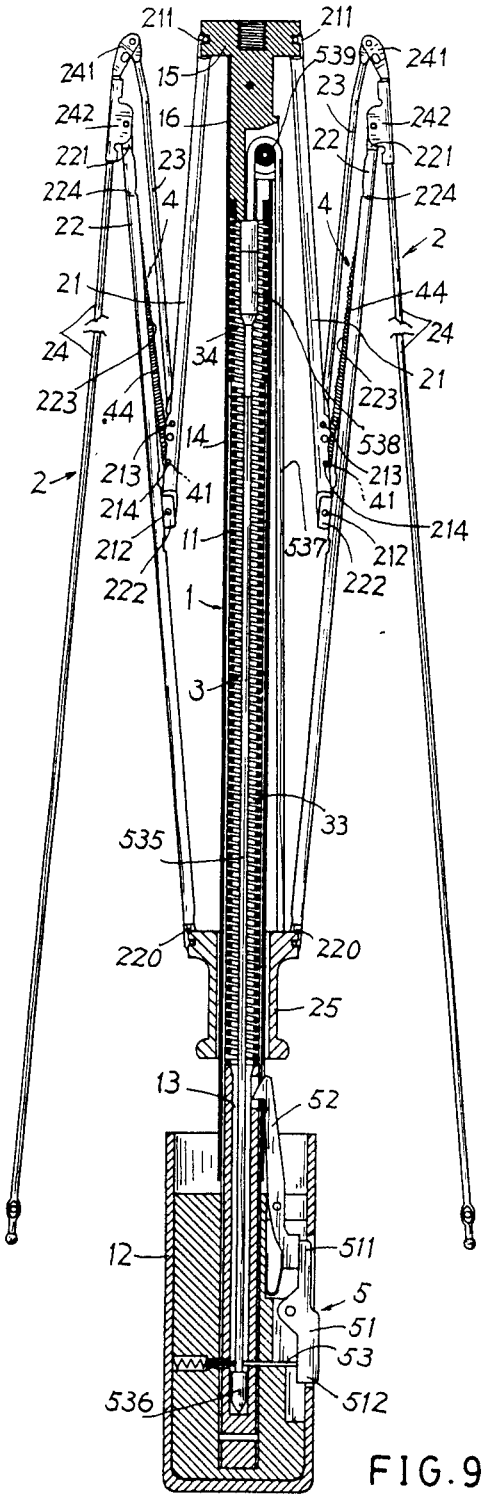
FIG. 9 shows a folded umbrella in accordance with the present invention.

As shown in FIGS. 1 and 9, the present invention comprises all basic elements as disclosed in original application and comprises: a central shaft means 1 having a lower tubular shaft 11, a grip 12, a sleeve 13, an upper tubular shaft 14, an upper notch 15 and an inner block 16; a rib assembly 2 including a first top rib 21, a stretcher rib 22, a second top rib 23 and a third top rib 24; an extending spring 3 for opening the umbrella; at least a retraction restoring spring 4 for closing the umbrella; and a control means 5 including a seesaw button 51, an extension controller 52 for controlling the extension of upper shaft 14 and the opening of the umbrella, and a retraction controller 53 for controlling the retraction of the rib assembly 2 and the closing of the umbrella. The second top rib 23 is secured between an innermost end portion 241 of the third rib 24 and a second outer portion 213 next to a first outer portion 214 of the first rib 21 having an inner portion 211 pivotally secured to the upper notch 15.

As shown in FIG. 1–4, the retraction restoring spring 4 formed as a coil spring includes an inner spring end 41 secured to a first outer portion 214 approximate to an outermost end portion 212, and a contraction spring portion 43 contracting its diameter for forming a narrow neck portion between an outermost spring end 42 and a middle spring portion 44. The stretcher rib 22 formed with a longitudinal groove 223*a* defined by two longitudinal side walls 223 having a cross section of U shape includes: an inner end portion 220 pivotally secured to the runner 25, an outermost end portion 221 pivotally secured to an inner portion 242 of the third top rib 24, a middle portion 222 pivotally secured with the outermost end portion 212 of the first top rib 21, and a concavely depressed portion 224 by pressing the two side walls 223 inwardly and formed on an outer portion near the outermost end portion 221 of the stretcher rib 22. The contraction spring portion 43 of the retraction restoring spring 4 is snugly embedded in the concavely depressed portion 224 of the stretcher rib 22 for fixing the outer spring end 42 in the stretcher rib 22.

By the way, when the umbrella is opened as shown in FIG. 1 the restoring spring 4 is compressed for restoring its resilience ready for urging the rib assembly 2 inwardly towards the central shaft means 1 for closing the umbrella. During the compression or tensioning of the spring 4, the spring portion between the middle spring portion 44 and the outermost end portion 42 are slidably held in the U-shaped groove 223*a* of the stretcher rib 22 for tangentially developing the spring force to prevent from being twisted, deformed, tangled for the smooth operation of the restoring spring 4.

As shown in FIG. 5, the extending spring 3 is modified from the original application to include a lower spring portion 33 having small diameter of each spring ring of the spring portion 33 to be slidably telescopically received in the lower shaft 11 and an upper spring portion 34 having a large diameter of each spring ring larger than the diameter of the lower spring portion 33 to be slidably telescopically received in the upper shaft 14 having an inside diameter larger than an inside diameter of the lower shaft 11. A lowest spring ring 341 of the upper spring portion 34 is retained on an uppermost perimeter 112 of the lower shaft 11 and an uppermost spring ring 332 of the lower spring portion 33 is pertinent to the lowest ring 341 of the upper spring portion 34. Accordingly, the wider upper spring portion 34 of the extending spring 3 is tensioned or compressed inside the upper shaft 14, whereas the narrower lower spring portion 33 is acted inside the lower shaft 11 for a very smooth spring action for preventing from being twisted or tangled and for a silent sliding extending or retracting operation of the shaft means 1 when opening or closing the umbrella.

As shown if FIG. 6, the uppermost spring ring 332 of the lower spring portion 33 is secured in a retaining ring 35 having an outside diameter larger than an inside diameter of the lower shaft 11 for slidably contacting the upper shaft 14. The lowest ring 341 of the upper spring portion 34 is retained on the retaining ring 35. Therefore, the upper spring portion 34 may be slidably telescopically acted in the upper shaft 14, whereas the lower spring portion 33 may be slidably held in the lower shaft 11.

Figure 7:
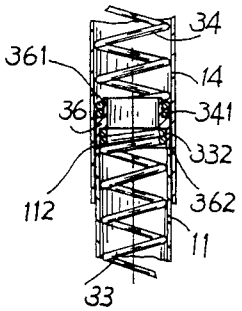
FIG. 7 shows still another preferred extending spring of the present invention.

As shown in FIG. 7, the spring ring 35 as shown in FIG. 6 is now modified to be a retaining collar 36 having an upper sleeve portion 361 for disposing a lowest ring 341 therearound and a lower socket 362 for inserting an uppermost ring 332 therein. The lower socket 362 is retained on an upper perimeter 112 of the lower shaft 11. By the way, the upper spring portion 34 is smoothly telescopically held in the upper shaft 14 and the lower spring portion 33 is also smoothly held in the lower shaft 11.

Figure 8:
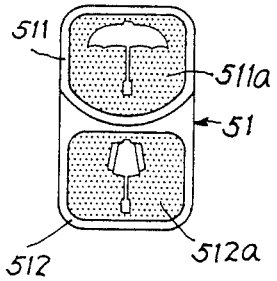
FIG. 8 shows a marked seesaw button of the control means of the present invention.

As shown in FIG. 8, the upper lever 511 of the seesaw button 51 is marked with an illustration of opened umbrella 511*a* to indicate the lever 511 which can be depressed to actuate the extension controller 52 for opening the umbrella; and the lower lever 512 is marked with an illustration of closed umbrella 512*a* to indicate the lever 512 which can be depressed to actuate the retraction controller 53 for closing the umbrella.

I claim:

1. An automatic umbrella comprising:

a central shaft means including a lower tubular shaft, a grip fixed on a lower portion of said lower tubular shaft, a sleeve inserted in said lower shaft, an upper tubular shaft telescopically mounted on said lower tubular shaft, and an upper notch formed on an upper portion of said upper shaft;

a rib assembly for securing an umbrella cloth thereon including a first top rib having an inner end portion of said first top rib pivotally secured to said upper notch and having an outermost end portion of said first top rib secured to a middle portion of a stretcher rib having an inner end portion of said stretcher rib pivotally secured to a runner slidably encompassed on said upper shaft and second top rib pivotally secured between said first top rib and an innermost end portion of a third top rib, said stretcher rib having an outermost end portion pivotally secured to an inner end portion of said third top rib approximate to said innermost end portion of said third top rib, said stretcher rib formed with a longitudinal groove defined between two longitudinal side walls having across section of U shape;

an extending spring formed as an elongate coil spring retained in said central shaft means having a lower end of said extending spring retained on an upper end of said sleeve and having an upper end of said extending spring retained on an inner block secured to said upper notch inside said upper shaft, said extending spring having a length when releasing its elastic force upon an extension of said central shaft means generally equal to a length of extended central shaft means;

at least a retraction restoring spring secured between an outer end portion of said first top rib and an outer end portion of said stretcher rib normally urging said rib assembly downwardly inwardly towards said central shaft means for closing the umbrella; and a control means including a seesaw button seesawly formed in said grip and selectively actuating an extension controller formed in an upper portion of said grip for extending said shaft means and opening the umbrella, or actuating a retraction controller generally formed in a lower portion of said grip and inside said shaft means for closing the umbrella;

the improvement which comprises:

said retraction restoring spring having a contraction spring portion formed on an outer spring end between an outermost spring end of said restoring spring and a middle spring portion of said restoring spring;

said stretcher rib having a concavely depressed portion formed on an outer portion of said stretcher rib approximate to said outermost end portion of said stretcher rib by pressing the two side walls of the stretcher rib inwardly;

said contraction spring portion of said restoring spring engageable with said concavely depressed portion of said stretcher rib for slidably holding an outer spring portion between the middle spring portion and the outermost end portion of the restoring spring in the longitudinal groove of said stretcher rib having a cross section of U shape for tangentially developing the spring force of the restoring spring.

2. An automatic umbrella according to claim 1, wherein the improvement comprises said extending spring formed in said central shaft means including a lower spring portion telescopically held in the lower tubular shaft, and an upper spring portion telescopically held in the upper tubular shaft with each spring ring having a diameter larger than a diameter of each spring ring of the lower spring portion.

3. An automatic umbrella according to claim 2, wherein a retaining ring is retained on an upper perimeter of said lower tubular shaft for fixing an uppermost ring of the lower spring portion in said retaining ring and for retaining a lowest ring of the upper spring portion on said retaining ring, said retaining ring being slidably contacted with said upper shaft having an outside diameter of the ring larger than an inside diameter of said lower shaft.

4. An automatic umbrella according to claim 2, wherein a retaining collar includes an upper sleeve portion for disposing a lowest ring of the upper spring portion on the upper sleeve portion, and a lower socket for fixing an uppermost ring of the lower spring portion in said socket, said retaining collar retained on an upper perimeter of said lower shaft for slidably contacting said supper shaft.

5. An automatic umbrella according to claim 1, waherein said seesaw button of said control means includes an upper lever marked with an illustration of an opened umbrella to indicate which upper lever can be depressed to actuate the extension controller for opening the umbrella, and a lower lever marked with an illustration of closed umbrella to indicate which lower lever can be depressed to actuate the retraction controller for closing the umbrella.

* * * * *